US005195870A

United States Patent [19]

Liu

[11] Patent Number: 5,195,870

[45] Date of Patent: Mar. 23, 1993

[54] CEILING FAN HAVING LIGHTING FIXTURE

[76] Inventor: Wun-Hui Liu, No. 2, Jiann Huon Lane, Jiunn Huon Li, Taichung, Taiwan

[21] Appl. No.: 814,649

[22] Filed: Dec. 30, 1991

[51] Int. Cl.[5] ..... F04D 29/70

[52] U.S. Cl. ..... 415/005; 362/96; 403/343

[58] Field of Search ..... 416/5; 362/96.294, 373, 362/404, 449; 403/343; 285/907

[56] References Cited

U.S. PATENT DOCUMENTS

| | | | |
|---|---|---|---|
| 2,307,247 | 1/1943 | Tuck et al. | 362/96 |
| 2,448,494 | 8/1948 | Moser | 285/907 |
| 2,472,624 | 6/1949 | Schwartz | 285/907 |
| 4,530,039 | 7/1985 | Shin-shi | 362/449 |
| 4,616,298 | 10/1986 | Bolson | 362/96 |
| 4,668,119 | 5/1987 | Galletti | 403/343 |
| 5,079,684 | 1/1992 | Lai | 362/96 |

*Primary Examiner*—John T. Kwon

*Attorney, Agent, or Firm*—Browdy and Neimark

[57] ABSTRACT

An improved ceiling fan having lighting fixture comprises mainly a shaft with a fastening end fastened to the ceiling and with a free end of a predetermined length extending downwardly, a main body fastened to the free end of the shaft and provided with a swivel portion, lighting fixtures arranged under the main body, a plurality of fan blades fastened respectively to the swivel portion of the main body and between the lighting fixtures and the ceiling, and a light reflecting apparatus disposed at the upper end of the main body and provided with means to emit light of an intensity capable of projecting on the ceiling from which the ceiling fan is suspended.

7 Claims, 2 Drawing Sheets

CEILING FAN HAVING LIGHTING FIXTURE

BACKGROUND OF THE INVENTION

The present invention relates to a ceiling fan, and more particularly to the improved structures of a ceiling fan having lighting fixture.

As shown in FIG. 1, a conventional ceiling fan 10 comprises a main body 12 with lighting fixtures 14 arranged under the fan blades 16 so as to permit the shadow of fan blades to project upwardly toward the ceiling 18 from which the ceiling fan 10 is suspended. However, the distance between the fan blades 16 and the ceiling 18 is generally not long enough to prevent the shadows of fan blades 16 on the ceiling 18 from reflecting toward the floor of the room in which the ceiling fan 10 is located. As a result, the persons in the room have to put up with the nuisance of flashing of shadows of fan blades.

SUMMARY OF THE INVENTION

It is therefore the primary objective of the present invention to provide a ceiling fan having lighting fixture with means capable of dispersing the projected shadows of fan blades so as to eliminate the projected shadows of fan blades on the ceiling from which the fan is suspended.

In keeping with the principles of the present invention, the primary objective of the present invention is accomplished by a ceiling fan comprising a main body provided with a light reflecting apparatus disposed at upper end of main body and between the ceiling and the fan blades. Such light reflecting apparatus emits light of a predetermined intensity, which is projected on the ceiling from which the fan is suspended and is used to cancel out the projected light of the lighting fixture of the fan.

DETAILED DESCRIPTION OF THE PREFERRED EMBODIMENT

Figure 1:
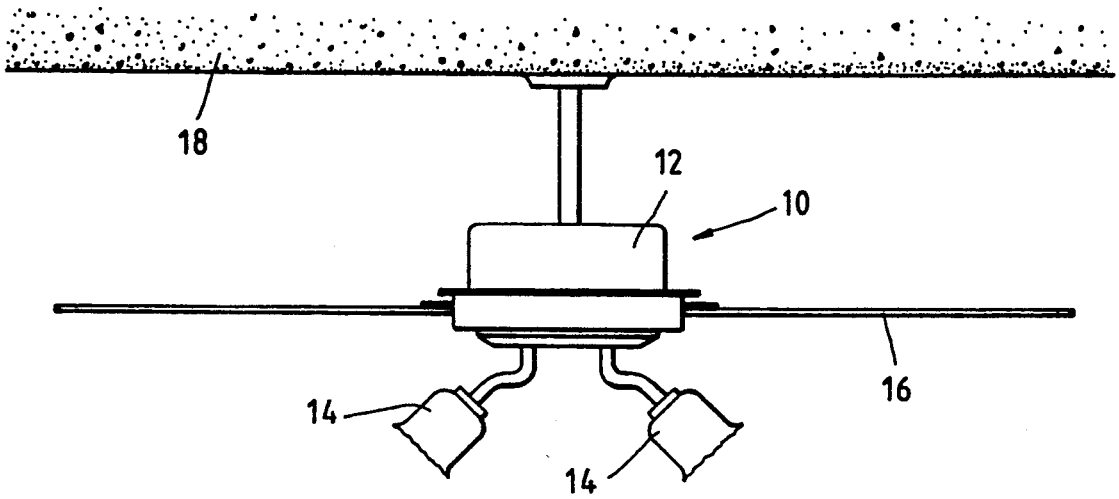
FIG. 1 PRIOR ART
FIG. 1 shows a front view of a conventional ceiling fan of prior art.
Figure 2:
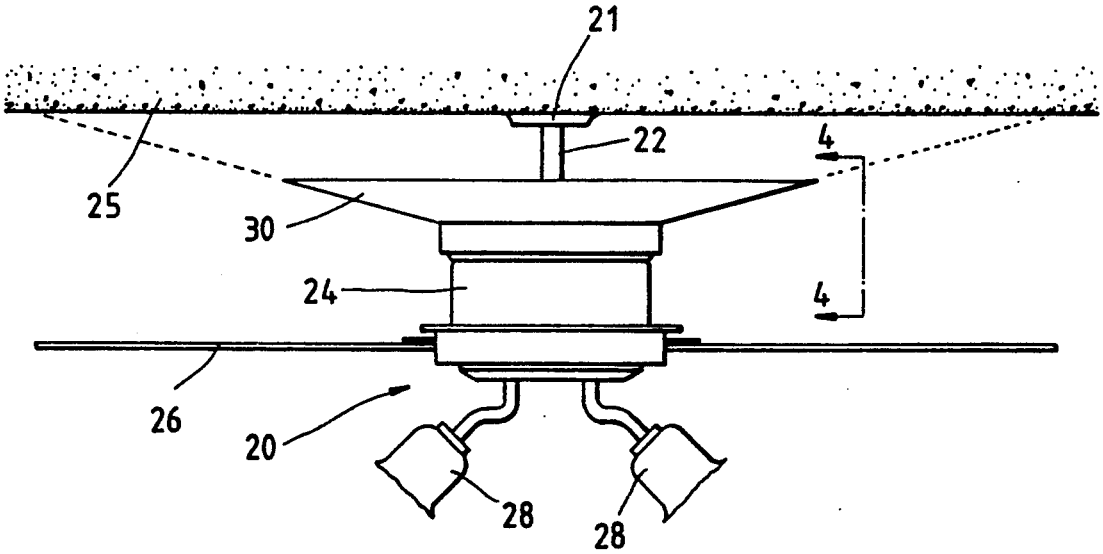
FIG. 2 shows a front view of the ceiling fan embodied in the present invention.
Figure 3:
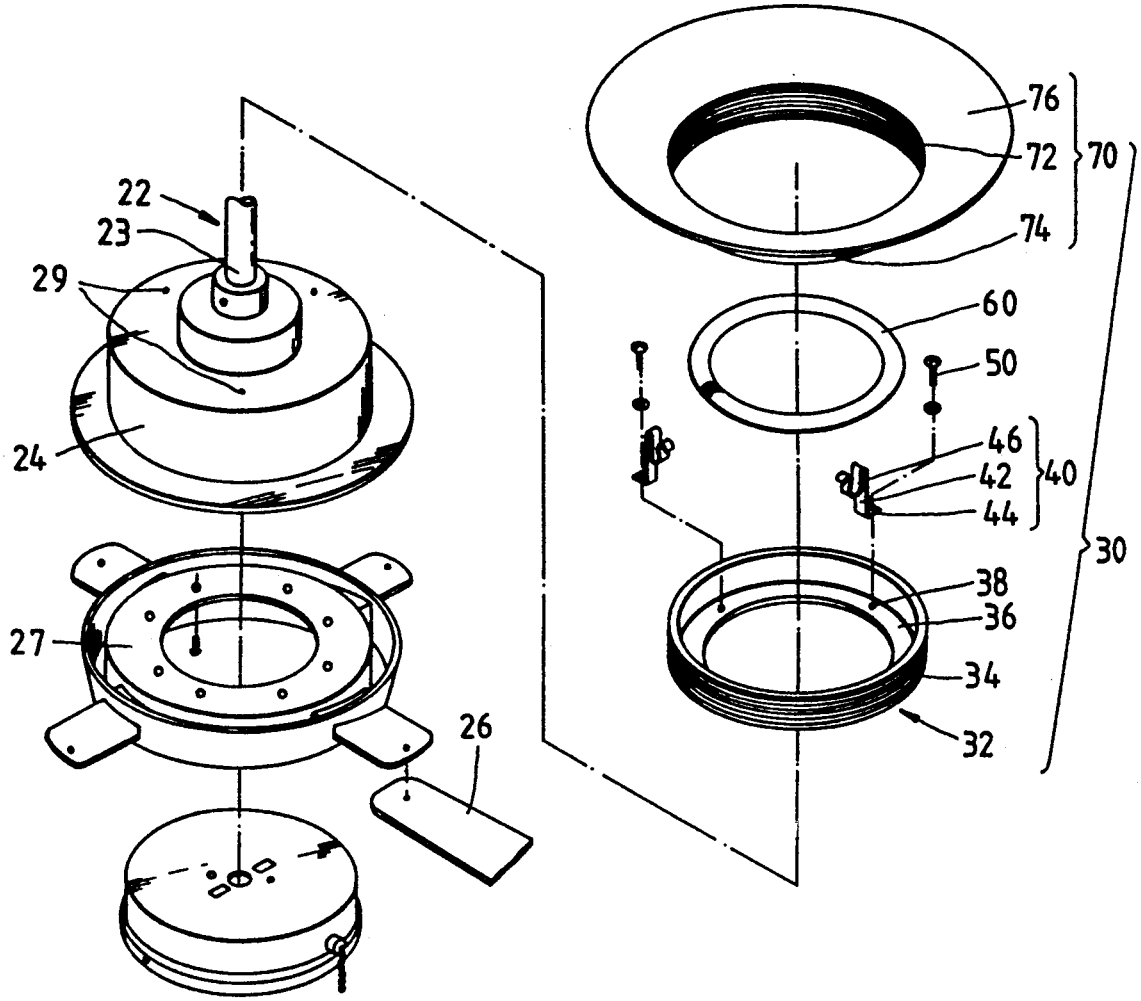
FIG. 3 shows an exploded view of the ceiling fan embodied in the present invention.
Figure 4:
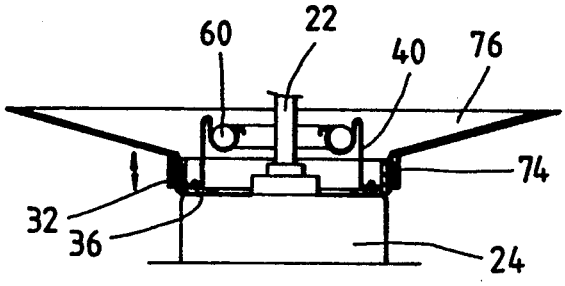
FIG. 4 shows a sectional view of the portion taken along the line 4–4 as shown in FIG. 2.

Referring to FIGS. 2, 3, and 4, the ceiling fan 20 embodied in the present invention is shown comprising a shaft 22, a main body 24, a plurality of fan blades 26, lighting fixtures 28, and a light reflecting apparatus 30.

The shaft 22 is fastened at the fastening end 21 to the ceiling 25 and has a free end 23 of a predetermined length extending downwardly therefrom. The main body 24 is fastened securely to the free end 23 and is provided therein with a swivel portion 27 and three threaded holes 29 disposed at the upper portion thereof and spaced at equal interval from the shaft 22. The fan blades 26 are respectively fastened to the periphery of the swivel portion 27. The lighting fixtures 28 are arranged at the lower end of main body 24.

The light reflecting apparatus 30 comprises a base 32 of cylindrical construction which is provided at outer edge thereof with a threaded portion 34, a circular edge 36 extending inwardly from the bottom thereof, and the three first through holes 38 positioned correspondingly to the three threaded holes 29 of the main body 24. In addition, the light reflecting apparatus 30 is composed of three curved support pieces 40, each of which is provided with a locking portion 42 having thereon a second through hole 44, and with a semi-circular receiving portion 46 having thereon a recessed surface facing upwardly. The light reflecting apparatus 30 further comprises three screws 50, a fluorescent light tube 60 of circular construction, and a reflecting member 70.

The three locking screws 50 engage via first and second through holes 38 and 44 respectively the three threaded holes 29 so as to secure the base 32 and support pieces 40 in place at the upper end portion of the main body 24.

The fluorescent light tube 60 of circular construction is disposed on the receiving portion 46 in such a manner that the tube is positioned slightly above the upper end portion of the base 32. The power source of the fluorescent light tube 60 is connected with a light adjusting device serving to control the intensity of light emitted by the fluorescent light tube 60 and projected on the ceiling 25 to be corresponding to the intensity of light emitted by the lighting fixture 28. The light adjusting device mentioned above is beyond the scope of the present invention and will not be therefore described further.

The reflecting member 70 has a cylindrical body portion 74, which is provided on the inner wall surface thereof with a threaded portion 72 and with a circular trumpet-like reflecting portion 76. The body portion 74 is united with the base 32 by means of its threaded portion 72 which engages the threaded portion 34 of the base 32 in such a manner that the body portion 74 can be adjusted upwardly and downwardly as required. The reflecting portion 76 is made integrally with the upper end portion of body portion 74 and extends coaxially with the body portion 74 in such a way that its inner diameter increases progressively toward its upper end from its lower end.

The shadows of fan blades 26 projected by the lighting fixture 28 on the ceiling 25 are effectively cancelled out by the light which is emitted by the fluorescent light tube 60 and is reflected on the ceiling 25 by the reflecting portion 76. The distance between the reflecting portion 76 and the ceiling 25 can be adjusted by rotating the reflecting member 70 in a clockwise direction or in a counter clockwise direction so that the range of the light projected on the ceiling 25 by the reflecting portion 76 can be adjusted accordingly.

The embodiment of the present invention described above is to be considered in all respects as merely an illustration of principles of the present invention. Accordingly, the present invention is to be limited only by the scope of the hereinafter appended claims.

What I claim is:

1. An improved ceiling fan having a lighting fixture for use on a ceiling comprising:

a shaft having first end fastened to the ceiling and having a length extending downwardly;

a main body fastened to a second end of said shaft, a swivel portion rotatably mounted on a lower side of said main body;

a first lighting fixture mounted to said main body under said swivel portion;

a plurality of fan blades fastened respectively at one end thereof to said swivel portion and between said lighting fixture and said ceiling; and light reflecting means mounted on an upper side of said main body for emitting light on said ceiling to eliminate shadows created by light from said first lighting fixture on said fan blades.

2. An improved ceiling fan having a lighting fixture according to claim 1, wherein said light reflecting means comprises a reflecting member and a power source disposed in said main body, wherein the light emitted by said light reflecting means is reflected on said ceiling via said reflecting member.

3. An improved ceiling fan having a lighting fixture according to claim 2, wherein said reflecting member comprises:

a locking base fastened to said upper side of said main body and provided thereon with a first locking portion; and a reflecting shade provided with a second locking portion engaging said first locking portion and with a reflecting portion of a width extending upwardly and then outwardly from the upper end of said second locking portion.

4. An improved ceiling fan having a lighting fixture according to claim 3, wherein said locking base is of circular construction of a height and is provided coaxially with a first threaded portion on outer circumference thereof, and wherein said second locking portion is of cylindrical construction and is provided on inner circumference thereof with a second threaded portion engaging said first threaded portion in such a manner that said reflecting shade can be rotated to adjust the distance between said reflecting shade and said ceiling.

5. An improved ceiling fan having a lighting fixture according to claim 3, wherein said first locking portion comprises a circular flange disposed at one end thereof, said flange having a third locking portion engaging said main body.

6. An improved ceiling fan having a lighting fixture according to claim 5, wherein said third locking portion comprises a plurality of through holes positioned correspondingly to threaded holes of said main body.

7. An improved ceiling fan having a lighting fixture according to claim 1, wherein said light reflecting means emits light of an intensity no less than the intensity of light emitted by said lighting fixture.

* * * * *